US009210748B2

(12) United States Patent
Evans et al.

(10) Patent No.: US 9,210,748 B2
(45) Date of Patent: Dec. 8, 2015

(54) SYSTEMS AND METHODS OF DRIVING MULTIPLE OUTPUTS

(71) Applicant: Texas Instruments Incorporated, Dallas, TX (US)

(72) Inventors: David Wayne Evans, Bentonville, AR (US); Kevin Scoones, Sunnyvale, CA (US); James Larry Krug, Rowlett, TX (US); Pradeep Katikaneni, Plano, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 48 days.

(21) Appl. No.: 14/085,765

(22) Filed: Nov. 20, 2013

(65) Prior Publication Data

US 2015/0137700 A1 May 21, 2015

(51) Int. Cl.
*H05B 33/08* (2006.01)

(52) U.S. Cl.
CPC ..... *H05B 33/0815* (2013.01); *H05B 33/0827* (2013.01)

(58) Field of Classification Search
CPC ..... H05B 33/0815; H05B 33/0827
USPC ..... 315/294, 297, 307, 209 R
See application file for complete search history.

(56) References Cited

U.S. PATENT DOCUMENTS

| | | | | |
|---|---|---|---|---|
| 5,521,809 | A * | 5/1996 | Ashley et al. | 363/71 |
| 2009/0295775 | A1* | 12/2009 | Kim et al. | 345/212 |
| 2010/0220049 | A1* | 9/2010 | Murakami | 345/102 |
| 2011/0298384 | A1* | 12/2011 | Tanigawa et al. | 315/209 R |
| 2014/0340615 | A1* | 11/2014 | Kikuchi et al. | 349/61 |

* cited by examiner

*Primary Examiner* — Don Le
(74) *Attorney, Agent, or Firm* — Lawrence J. Bassuk; Frank D. Cimino

(57) ABSTRACT

Systems and methods of driving multiple outputs are provided in which a single inductor may be used to drive multiple output such as independent strings of LEDs or white LEDs (WLEDs). In an example embodiment, a boost DC to DC converter may be used with a single inductor to drive multiple outputs. In an example embodiment, the error voltage of each of the multiple outputs is sampled during each cycle of the DC to DC converter and the largest error voltage is determined for that cycle. Power from the DC to DC converter is then supplied to that output during that cycle.

18 Claims, 3 Drawing Sheets

SYSTEMS AND METHODS OF DRIVING MULTIPLE OUTPUTS

TECHNICAL FIELD

The present disclosure is generally related to electronics and, more particularly, is related to driving multiple outputs.

BACKGROUND

Switching power supplies are used to drive many types of loads. At times, it is desired to drive multiple loads using a single switching power supply requiring only a single inductor. This is particularly desired when driving multiple light emitting diode (LED) loads as it saves board space and money. Instead of using a power supply module to drive each string of LEDs, a single power supply module may be used to drive multiple LED strings. But as with many load types, it may be important to properly regulate the power delivered to the load.

A commonly used switching power supply topology uses current mode control. Current mode control, as usually implemented in switching power supplies, actually senses and controls peak inductor current. This may give rise to many serious problems, including poor noise immunity, a need for slope compensation, and peak-to-average current errors which an inherently low current loop gain cannot correct. Average current mode control eliminates these problems and may be used effectively to control currents other than inductor current, allowing a much broader range of topological application.

Current mode control is a two-loop system in which the switching power supply inductor is located within the inner current control loop. This simplifies the design of the outer voltage control loop and improves power supply performance in many ways, including better dynamics. The objective of this inner loop is to control the state-space averaged inductor current, but in practice the instantaneous peak inductor current is the basis for control. In many designs, switch current, which is equal to inductor current during the "on" time of the switch, is often sensed.

In a conventional switching power supply employing a buck derived topology, the inductor is located in the output. Current mode control then is actually controlling the output current, resulting in many performance advantages. On the other hand, in a boost topology, the inductor is located at the input. Current mode control then controls input current. The technique of average current mode control introduces a high gain integrating current error amplifier (CA) into the current loop. A voltage across a sense resistor represents the desired current program level. The voltage across the current sense resistor represents actual inductor current. The difference, or current error, is amplified and compared to a large amplitude sawtooth (oscillator ramp) at the PWM comparator inputs. The gain-bandwidth characteristic of the current loop can be tailored for optimum performance by the compensation network around the CA. The average current mode method can be used to sense and control the current in any circuit branch. Thus it can control output current with boost topologies, for example.

LEDs are semiconductors with light-emitting junctions designed to use low-voltage, constant current DC power to produce light. LEDs may use an average current, boost mode switching power supply. LEDs have polarity and, therefore, current only flows in one direction. Driving LEDs is relatively simple and, unlike fluorescent or discharge lamps, they do not require an ignition voltage to start. However, too little current and voltage will result in little or no light, and too much current and voltage can damage the light-emitting junction of the LED diode.

When lighting designers arrange a series of LED strings in applications such as street lights or industrial lights, each string have been driven at a consistent current by an individual LED driver. However, the output voltage often varies due to differences in the manufacturing of the LEDs. To compensate, LED drivers may be configured to provide higher-than-needed voltage to ensure proper operation of each LED string. Too much voltage, though, can waste power.

With a typical LED forward voltage vs. forward current profile, for a given temperature, a small change in forward voltage produces a disproportionately large change in forward current. In addition, the forward voltage required to achieve a desired light output can vary with LED die size, LED die material, LED die lot variations, and temperature.

As LEDs heat up, the forward voltage drops and the current passing through the LED increases. The increased current generates additional heating of the junction. If nothing limits the current, the junction may fail due to the heat. This phenomenon is referred to as thermal runaway.

Light output of LED light sources increases with increasing drive current. However the efficiency, expressed in lumens per watt, is adversely affected. Drive currents may be chosen at any current up to the maximum recommended current for the specific LED light source used. Driving LED light sources above the maximum recommended currents may result in lower lumen maintenance or, with excessive currents, catastrophic failure.

In non-dimming applications, a constant-current driver is chosen to deliver the desired current, with enough forward voltage output to accommodate the maximum input voltage of the LED source. LED light sources are not designed to be driven with a reverse voltage.

By driving LED light sources with a regulated constant-current power supply the light output variation and lifetime issues resulting from voltage variation and voltage changes can be significantly reduced. Therefore, constant current drivers are generally recommended for powering LED light sources.

Conventional AC-DC power supplies and DC-DC converters provide an output that is regulated to provide a "constant-voltage." However, LEDs work most efficiently and safest with a "constant-current" drive. LED power sources that provide a "constant-current" output have typically been referred to as LED drivers. However, there are heretofore unaddressed needs with previous solutions for driving multiple LED outputs with a single inductor in the switching power supply power train, which include crosstalk and inefficiency.

SUMMARY

Example embodiments of the present disclosure provide systems of driving multiple outputs. Briefly described, in architecture, one example embodiment of the system, among others, can be implemented as follows: a control module configured to supply current from a pulse width modulation output configured to drive a plurality of loads to at most one load of the plurality of loads at one time, the one load selected based on its error voltage being the largest of the error voltages of each of the plurality of loads.

Embodiments of the present disclosure can also be viewed as providing methods for driving multiple outputs. In this regard, one embodiment of such a method, among others, can be broadly summarized by the following steps: supplying power to a plurality of loads, each load of the plurality of loads producing an error signal; and selecting one load of the plurality of loads to supply power to during a single cycle of the pulse width modulation output, the selected load producing a largest error signal of the plurality of error signals of the plurality of loads.

DETAILED DESCRIPTION

Figure 1:
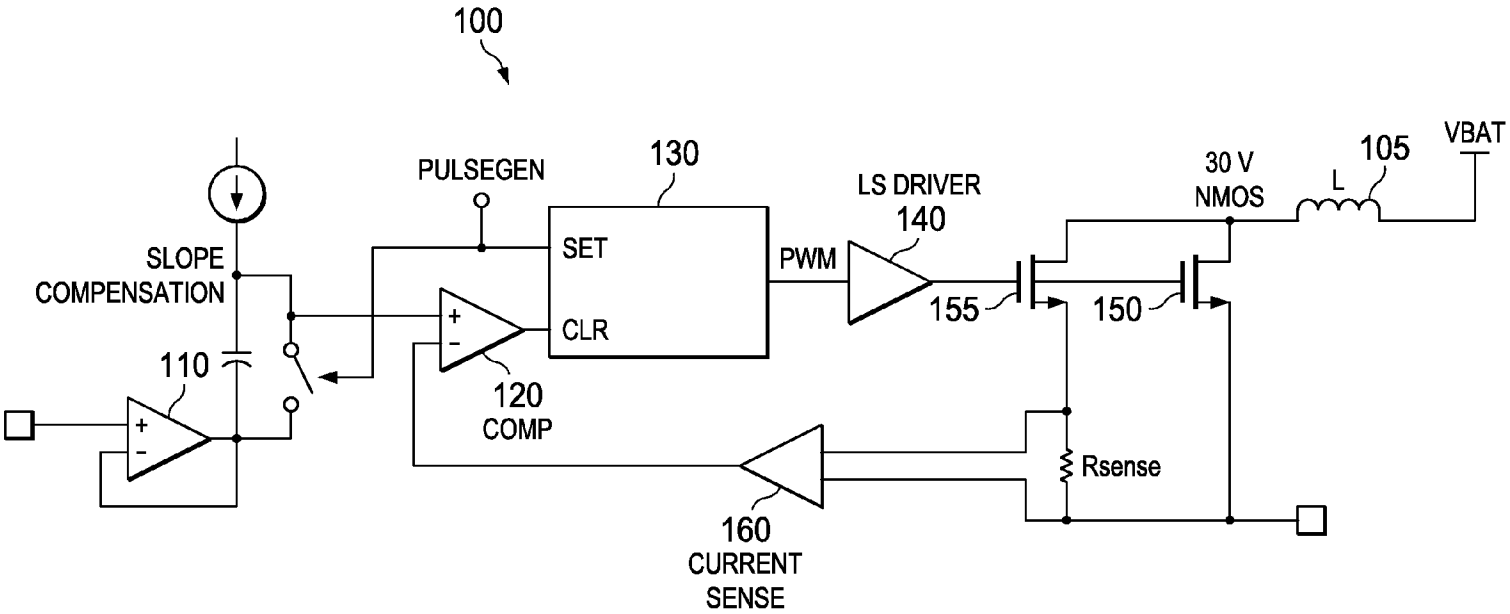
FIG. 1 is a circuit diagram of an example embodiment of a switching converter to be used with the disclosed systems and methods of driving multiple outputs.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Most commercially available LED "light modules" are constructed by connecting a number of LEDs in series or parallel to form cluster or string configurations. In cases where these light modules include a "constant-current" driver as part of the assembly, an external "constant-voltage" driver or power supply is used. Some LED circuits control the current flowing through the LED with a simple resistor. This is another case where a constant-voltage power source is used. Other examples where external "constant-voltage" supplies have been employed include backlit ad signs, traffic information signs and large screen high definition LED displays.

In cases where a manufactured cluster or string of LEDs does not include an internal "constant-current" driver, an external LED driver or power supply that provides a "constant-current" is used. Constant current LED drivers are available in many different package configurations, ranging from integrated circuits to enclosed moisture-proof packages, depending on the application and the required output power.

Depending on the application, LEDs may be connected in series and/or parallel configurations. When LEDs are connected in series, the forward voltage drop of each LED in the string are additive. For example, if 15 LEDs are configured in series and each one has a voltage drop of 3V (at its nominal current), a voltage source of 45V (15×3V=45V) will drive the required current (there is also a small additional voltage drop across the sense element). Accordingly, "constant-current" driver specifications include the output voltage range that it is capable of providing to overcome the LED voltage drops. To limit the drive voltage to reasonable levels, multiple strings of series-connected LEDs may be placed in parallel and driven by multi-output constant-current drivers.

The light output of LEDs may be controlled by varying the amount of current flowing through the LED (within defined limits) or by turning the LED on and off via pulse width modulation (PWM). A variable resistor may be used to achieve analog dimming control. In this case, the maximum LED brightness occurs when the resistance is set to its minimum value. A pulse width modulation input may be used to control LED brightness by varying the duty-cycle of the input signal from 1% to 100%. Typical PWM frequencies range from 180 to 270 Hz.

LEDs have a relatively quick response time (~20 nanoseconds), and instantaneously reach full light output. Therefore, many of the undesirable effects resulting from varying current levels, such as wavelength shift or forward voltage changes, can be minimized by driving the light engine at its rated current and rapidly switching that current on and off. PWM is the best way to achieve stable results for applications that require dimming to less than 40% of rated current. By keeping the current at the rated level and varying the ratio of the pulse "on" time versus the time from pulse to pulse (commonly referred to as the duty cycle), the brightness can be lowered. The human eye can not detect individual light pulses at a rate greater than 200 cycles per second and averages the light intensity thereby perceiving a lower level of light.

In an example implementation of the disclosed systems and methods of driving multiple outputs, a single inductor may be used to drive multiple independent strings of LEDs or white LEDs (WLEDs) such as a backlight driver or a display driver for a mobile device. In an example embodiment, a boost DC to DC converter may be used with a single inductor to drive multiple outputs. The inductor may be larger than the power control integrated circuit chip, so the fewer the inductors, the better. The multiple outputs could be used to drive, for example, a keyboard driver, a camera flash, and a display backlight and driver, and only one inductor is used. The systems and methods of driving multiple outputs disclosed herein may be used, as a non-limiting example, to drive a WLED load with advantages of high efficiency and lack of cross-talk. In an example embodiment, the error voltages of each of the multiple outputs is sampled during each cycle of the DC to DC converter and the largest error voltage is determined for that cycle. Power from the DC to DC converter is then supplied to that output during that cycle.

With cross-talk, noise from one output is reflected on one of the other outputs. In multiple output applications, efficiency may be lost because the outputs may need different output voltage levels (for example driving both a 6 LED string and a 9 LED string). The output voltage of the power supply module is set at the highest voltage and the others are driven through a resistor divider or some other mechanism to lower the output voltage, causing a drop in efficiency.

FIG. 1 provides switching converter 100 as an example switching converter to be used in the disclosed systems and methods of driving multiple outputs. Switching converter 100 is a boost converter configured for peak current mode control with synchronous power FETs. In an example embodiment, low side power FET 150 may be singular, and may be shared between the multiple output loops. Low side FET sense device 155 in combination with an accurate internal sense resistor may be used to convert the current through inductor 105 during the on-state of low side FET 150 to a voltage waveform. In an example embodiment, the waveform is compared to the slop-compensated (in slope compensation amplifier 110) error signal to generate the PWM control signal of the low side FET. The frequency of operation of the converter may be set via the PULSEGEN signal into SR latch 130.

The current in inductor 105, sampled through low side FET 155, is used to charge or discharge into the load by grounding low side FET 150 (low side FET 150 and sense FET 155 are turned on substantially simultaneously). Sense FET 155 feeds current sense amplifier 160, amplifying the voltage across the sense resistor, which provides information about the current through the inductor. The amplified current sense signal is then fed into PWM comparator 120. Slope compensation comparator 110 takes the error signal from the output of the power module and uses slope compensation to provide stability. The slope compensated error signal and the current sense signal are used to generate the PWM signal through SR flip flop 130 and low side driver 140 to turn the gate of low side FET 150 on and off.

Figure 2:
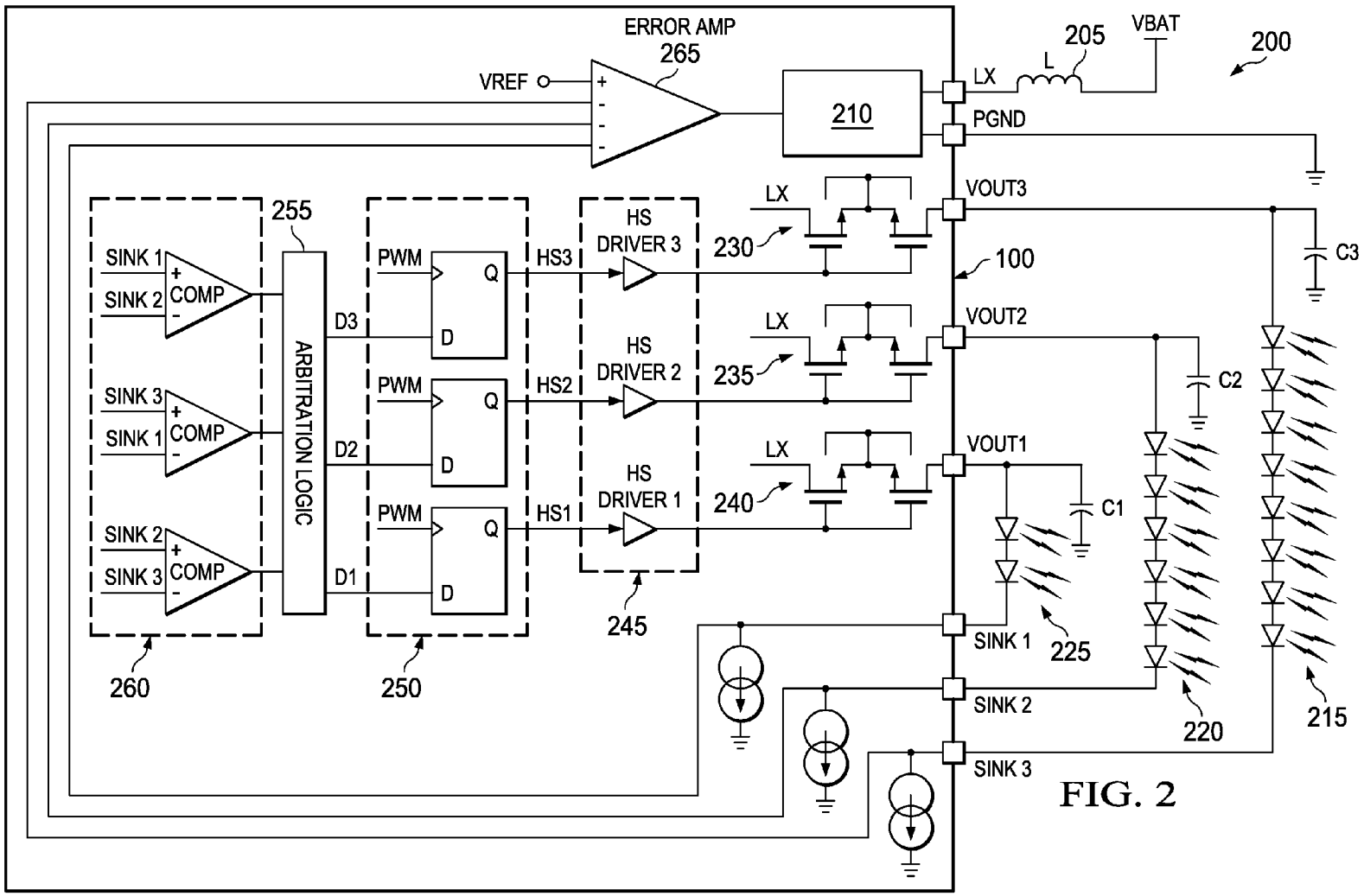
FIG. 2 is a circuit diagram of an example embodiment of a system of driving multiple outputs.

FIG. 2 provides an example embodiment of the disclosed system and methods of driving multiple outputs with high side FETs 230, 235, and 240. FIG. 2 provides for 3 high side FETS, but any number of high side FETs could conceivably be used, depending on how many outputs are desired. LX is the switch node which is connected to the bottom of the inductor at the output of switching converter 100 of FIG. 1. If low side FET 150 is turned on, one side of inductor 205 is grounded and it is charged with Vbat in the example circuit of FIG. 2 When low side FET 150 is turned off, one of high side FETS 230, 235, and 240 are turned on and the charge stored in inductor 205 delivers the power to the load. The feedback loop works to maintain voltage regulation on the SINKx input pins at the bottom of LED strings 215, 220, and 225. The SINKx paths can be independently enabled or disabled, not affecting the operation of any other SINKx. In an example embodiment, each SINKx input features a regulated current sink and may have independent brightness and dimming (analog and digital) control. These may be accessed via an analog PWM input, or via a digital register or state machine control. In an example emboidiment, the SINKx feedback voltages are fed to summing error amplifier 265 which generates an error signal proportional to the total error of the LED strings.

The back to back nature of the FETS in high side FETs 230, 235, and 240 work to prevent leakage from the FET body diodes going back into the LX node from VOUTx. The charge from inductor 205 is applied to the output that has the largest error signal per cycle. In an alternative embodiment, the charge from inductor 205 is applied to the output that has the largest percentage error signal per cycle (Verr/VOUTx). In the example implementation of FIG. 2, there are three D flip flops in flip flop block 250 that are clocked with the PWM signal that is used to drive low side FET 150 of FIG. 1. Although three flip flops are used in flip flop block 250 of FIG. 2, any number of flip flops may be used depending on the number of outputs that are driven. Data is sent to flip flop block 250 with each clock signal. Arbitration logic block 255 decides whether to send a 1 or a 0 to each flip flop of flip flop block 250. With each clock cycle, arbitration logic block 255 determines which of the output voltages sampled at the SINK 1, SINK 2 SINK 3 nodes has the most error. Whichever output has the most error in that particular cycle will be the one which will have the power delivered to it. A new decision is made with each switching cycle. In an example embodiment, only one output path is charged per cycle.

In an example embodiment, arbitration logic 255 is fed by three comparators (the number of comparators depends on the number of output signals to be compared, such that the number of comparators is equal to the summation of N−x as x goes from 1 to N, where N is the number of output signals). Each comparator of comparator block 260 determines if one error voltage is higher than each of the other error voltages. Arbitration block 255 determines which output "wins" for that particular cycle and feeds the appropriate digital control to the "winning" flip flop which then gets clocked in and turns on one of high side FET 230, 235, and 240 as needed.

In an example embodiment, a user can control the brightness by sinking more current. Alternatively, a user can control the brightness with a PWM signal provided by a brightness and dimming control module. To set the voltages for the outputs of VOUT1, VOUT2, VOUT 3, VREF of 400 mV is used in this example implementation. Then the total error on any number of outputs is added back in the error signal in error amplifier 265 to control the charging of inductor 205. Since the outputs are unique, the cross-talk between the output loads is decreased. Also, efficiency is optimized due to using unique output voltages for each string.

Figure 3:
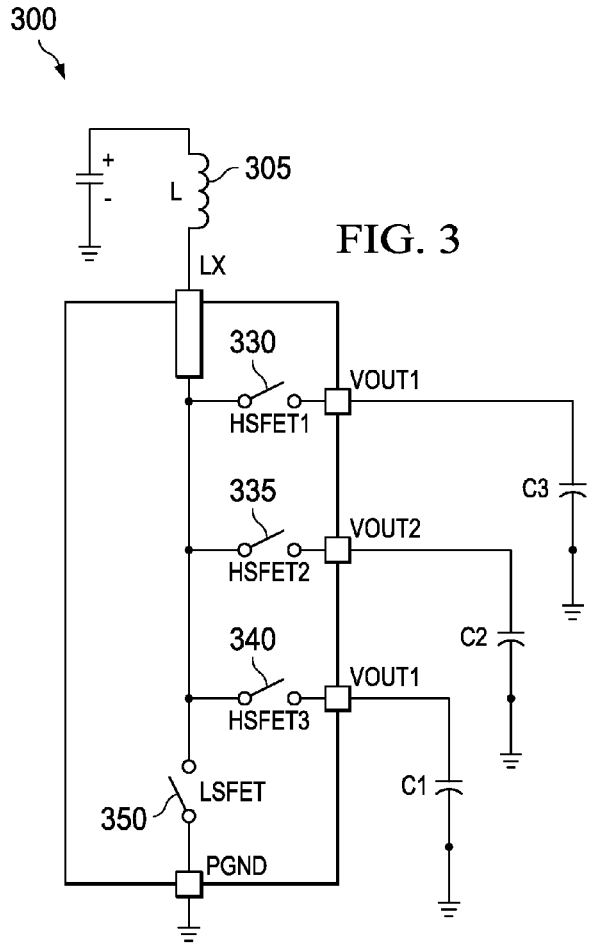
FIG. 3 is a circuit diagram of an example embodiment of the switching FETs of FIG. 2.

FIG. 3 provides circuit 300 of a simplified switch matrix for an example embodiment of a system of switching multiple outputs comprising inductor 305, low side FET 350 and high side FETs 330, 335, and 340. Inductor 305 is charged when low side FET 350 is closed and high side FETS 330, 335, and 340 are open. Power is delivered to a particular output when that output produces the largest error signal. During the power delivery cycle, low side FET 350 is open and one of high side FETs 330, 335, and 340 is closed. If VOUT1 produces the largest error signal, high side FET 330 is closed and FETs 335, 340, and 350 are open. If VOUT2 produces the largest error signal, FET 335 is closed and FETs 330, 340, and 350 are open. If VOUT3 produces the largest error signal, FET 340 is closed and FETs 330, 335, and 350 are open. In an example embodiment, the error signals are sampled and compared for each cycle of the PWM signal of switching converter 100.

Figure 4:
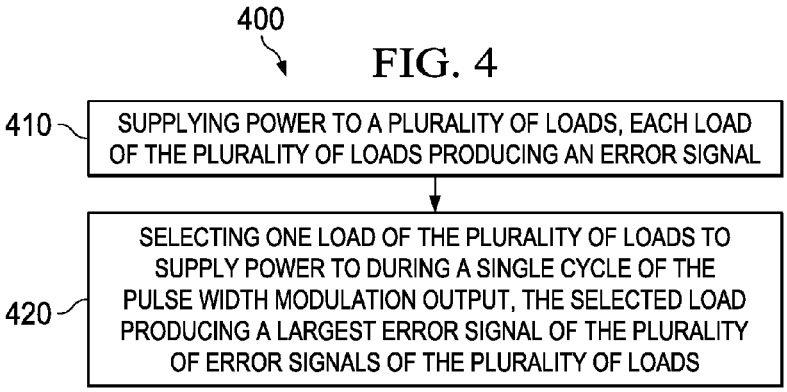
FIG. 4 is a flow diagram of an example embodiment of a method of driving multiple outputs.

FIG. 4 provides flow diagram 400 of an example embodiment of a method of driving multiple outputs. In block 410, power is supplied to a plurality of loads, each load of the plurality of loads producing an error signal. In block 420, one load of the plurality of loads is selected to supply power to during a single cycle of the pulse width modulation output, the selected load producing a largest error signal of the plurality of error signals of the plurality of loads.

The flow chart of FIG. 4 shows the architecture, functionality, and operation of a possible implementation of the arbitration logic software. In this regard, each block represents a module, segment, or portion of code, which comprises one or more executable instructions for implementing the specified logical function(s). It should also be noted that in some alternative implementations, the functions noted in the blocks may occur out of the order noted in FIG. 4. For example, two blocks shown in succession in FIG. 4 may in fact be executed substantially concurrently or the blocks may sometimes be executed in the reverse order, depending upon the functionality involved. Any process descriptions or blocks in flow charts should be understood as representing modules, segments, or portions of code which include one or more executable instructions for implementing specific logical functions or steps in the process, and alternate implementations are included within the scope of the example embodiments in which functions may be executed out of order from that shown or discussed, including substantially concurrently or in reverse order, depending on the functionality involved. In addition, the process descriptions or blocks in flow charts should be understood as representing decisions made by a hardware structure such as a state machine.

The logic of the example embodiment(s) can be implemented in hardware, software, firmware, or a combination thereof. In example embodiments, the logic is implemented in software or firmware that is stored in a memory and that is executed by a suitable instruction execution system. If implemented in hardware, as in an alternative embodiment, the logic can be implemented with any or a combination of the following technologies, which are all well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc. In addition, the scope of the present disclosure includes embodying the functionality of the example embodiments disclosed herein in logic embodied in hardware or software-configured mediums.

Software embodiments, which comprise an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, or communicate the program for use by or in connection with the instruction execution system, apparatus, or device. The computer readable medium can be, for example but not limited to, an electronic, magnetic, optical, electromagnetic, infrared, or semiconductor system, apparatus, or device. More specific examples (a nonexhaustive list) of the computer-readable medium would include the following: a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical). In addition, the scope of the present disclosure includes embodying the functionality of the example embodiments of the present disclosure in logic embodied in hardware or software-configured mediums.

Although the present invention has been described in detail, it should be understood that various changes, substitutions and alterations can be made thereto without departing from the spirit and scope of the invention as defined by the appended claims.

Therefore, at least the following is claimed:

1. A system comprising:

a switching regulator;

at most one inductor connected between the switching regulator and a plurality of loads;

an arbitration logic module configured to sample an error voltage of each load of the plurality of loads during each cycle of the switching regulator and to supply power from the at most one inductor to the load of the plurality of loads with the largest error voltage of the sampled error voltages; and a plurality of comparators configured to compare the feedback of each of the plurality of loads with each other feedback of the plurality of loads for input into the arbitration logic module.

2. The system of claim 1, wherein the number of comparators is at least 2n, where n is the number of loads being driven.

3. The system of claim 1, further comprising, for each load:

a D flip flop;

a high side driver; and a pair of field effect transistors configured to drive each load.

4. The system of claim 3, wherein each D flip flop is clocked by a pulse width modulation signal from the switching regulator and receives an input from the arbitration logic module.

5. The system of claim 3, wherein the pair of field effect transistors is configured in a back to back configuration to supply power from the inductor to one of the plurality of loads.

6. The system of claim 1, further comprising a summing error amplifier configured to sum the error voltages of each load together for comparison to a reference voltage, the comparison setting the pulse width of the pulse width modulation signal of the switching regulator.

7. The system of claim 1, wherein the switching regulator comprises a boost regulator.

8. The system of claim 1, further comprising, for each load:

a regulated current sink configured to sink current from the inductor and across each load, the sampled error voltage sampled between the load and its current sink.

9. The system of claim 1, wherein at least one load comprises at least one white LED.

10. A switching power supply module comprising:

a control module configured to supply current from a pulse width modulation output configured to drive a plurality of loads to at most one load of the plurality of loads at one time, the one load selected based on its error voltage being the largest of the error voltages of each of the plurality of loads; and a plurality of comparators configured to compare the feedback of each of the plurality of loads with each other feedback of the plurality of loads for input into the arbitration logic module, the number of comparators being at least 2n, where n is the number of loads being driven.

11. The power supply module of claim 10, wherein the error voltages are sampled during each cycle of the pulse width modulation output.

12. The power supply module of claim 10, further comprising at most one inductor configured to supply current to the plurality of loads.

13. The power supply module of claim 10, further comprising a summing error amplifier configured to sum the error voltages of each load together for comparison to a reference voltage, the comparison setting the pulse width of the pulse width modulation output.

14. The power supply module of claim 10, further comprising, for each load:

a regulated current sink configured to sink current from the inductor and across each load, the sampled error voltage sampled between the load and its current sink.

15. A method of supplying power to a plurality of loads from a single pulse width modulation output, comprising:

supplying power to a plurality of loads, each load of the plurality of loads producing an error signal; and selecting one load of the plurality of loads to supply power to during a single cycle of the pulse width modulation output, the selected load producing a largest error signal of the plurality of error signals of the plurality of loads; and comparing the feedback of each of the plurality of loads with each other feedback of the plurality of loads for input into the arbitration logic module, the number of comparators being at least 2n, where n is the number of loads being driven.

16. The method of claim 15, wherein supplying power to the plurality of loads comprises supplying power to the plurality of loads with at most one inductor.

17. The method of claim 15, further comprising summing the error voltages of each load of the plurality of loads together for comparison to a reference voltage, the comparison setting the pulse width of the pulse width modulation output.

18. The method of claim 15, wherein at least one load comprises at least one white LED.

* * * * *